US009381539B2

(12) United States Patent
Carlsen et al.

(10) Patent No.: US 9,381,539 B2
(45) Date of Patent: Jul. 5, 2016

(54) ADJUSTABLE FLOW EDGE SEAL APPLICATOR

(75) Inventors: Joshua P. Carlsen, Spanaway, WA (US); David Allen Triggs, Eatonville, WA (US); Michael B. Flannigan, Pacific, WA (US)

(73) Assignee: The Boeing Company, Chicago, IL (US)

( * ) Notice: Subject to any disclaimer, the term of this patent is extended or adjusted under 35 U.S.C. 154(b) by 2288 days.

(21) Appl. No.: 12/193,389

(22) Filed: Aug. 18, 2008

(65) Prior Publication Data

US 2010/0038029 A1 Feb. 18, 2010

(51) Int. Cl.
*B43M 11/02* (2006.01)
*B05C 17/035* (2006.01)

(52) U.S. Cl.
CPC ..... *B05C 17/0357* (2013.01); *Y10T 156/1798* (2015.01)

(58) Field of Classification Search
USPC ..... 401/208, 218–220
See application file for complete search history.

(56) References Cited

U.S. PATENT DOCUMENTS

| | | | | |
|---|---|---|---|---|
| 4,484,976 | A | 11/1984 | Despins | |
| 4,589,950 | A | 5/1986 | Sekavec, Jr. | |
| 6,494,245 | B1 | 12/2002 | Simone | |
| 6,789,974 | B2 * | 9/2004 | Atkinson et al. | 401/208 |
| 7,086,800 | B2 * | 8/2006 | Major et al. | 401/219 |

* cited by examiner

*Primary Examiner* — Tuan N Nguyen
(74) *Attorney, Agent, or Firm* — Yee & Associates, P.C.

(57) ABSTRACT

An apparatus for an adjustable flow edge seal applicator comprises a housing, a moveable applicator, and at least one channel. The housing has a cavity. The moveable applicator is moveably attached to the housing. The at least one channel has an inlet in communication with the cavity and an outlet in communication with the moveable applicator.

15 Claims, 8 Drawing Sheets

ADJUSTABLE FLOW EDGE SEAL APPLICATOR

BACKGROUND INFORMATION

1. Field

The present disclosure relates generally to manufacturing and in particular to a method and apparatus for applying seals to objects. Still more particularly, the present disclosure relates to a method and apparatus for applying a seal material to a surface of an object.

2. Background

Aircraft are being designed and manufactured with greater and greater percentages of composite materials. Some aircraft may have more than fifty percent of its primary structure made from composite materials. Composite materials may be used in an aircraft to decrease the weight of an aircraft. This decreased weight may improve payload capacities and fuel efficiencies. Further, composite materials may provide longer service life for various components in an aircraft.

Composite materials may be tough, light weight materials created by combining two or more of the similar components with each other. For example, a composite material may include fibers and resins. The fibers and resins may be combined and cured to form a composite material.

Composite materials may be used in various portions of an aircraft. These portions include, for example, skin panels, ribs, fuselage sections, and other suitable components. In manufacturing composite components, it may be desirable to seal the composite components. For example, a sealant may be applied to an edge of the composite component such as, for example, an edge of a skin panel or stringer for a wing. The sealant may be used to protect the composite part from the environment. The sealant may keep moisture out of an area on which the sealant is applied. The sealant may, for example, protect end fibers located at an edge of the composite component.

Currently, sealants may be applied using a brush or a roller. The sealant may be placed in a pan or lid and a brush or roller may be placed into the pan or the lid to coat the roller brush with the sealant. With this type of system, the user must repeatedly place the brush and/or roller into the pan or lid to obtain additional sealant. Further, applying sealants to the underside of parts may be more difficult. These types of systems also require repetitive motions by the user to apply the sealant.

Therefore, it would be advantageous to have an improved method and apparatus for applying sealants to a surface.

SUMMARY

The advantageous embodiments of the present invention provide a method and apparatus for an adjustable flow edge seal applicator. In one advantageous embodiment, an apparatus comprises a housing, a moveable applicator, and at least one channel. The housing has a cavity. The moveable applicator is moveably attached to the housing. The at least one channel has an inlet in communication with the cavity and an outlet in communication with the moveable applicator.

In another advantageous embodiment, an apparatus for applying a sealant comprises a housing, a wheel, a set of posts, and at least one channel. The housing has a cavity, and the wheel is moveably attached to the housing. The set of posts are located adjacent to the wheel. The at least one channel has an inlet in communication with the cavity and an outlet in communication with the wheel.

In still yet another advantageous embodiment, a method is present for applying a sealant to a surface of an object. An edge seal applicator is positioned relative to a surface of an object. The edge seal applicator has a housing, a cavity in the housing containing a sealant, a rotatable wheel, and at least one channel feeding the sealant to a surface of the rotatable wheel. The edge seal applicator moves to cause the rotatable wheel to move on the surface of the object. The sealant on the surface of the rotatable wheel is applied to the surface of the object.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
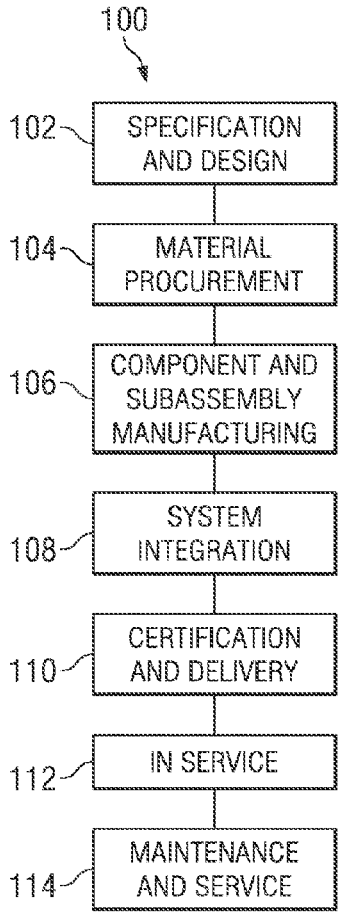
FIG. 1 is a diagram illustrating an aircraft manufacturing and service method in which an advantageous embodiment may be implemented.
Figure 2:
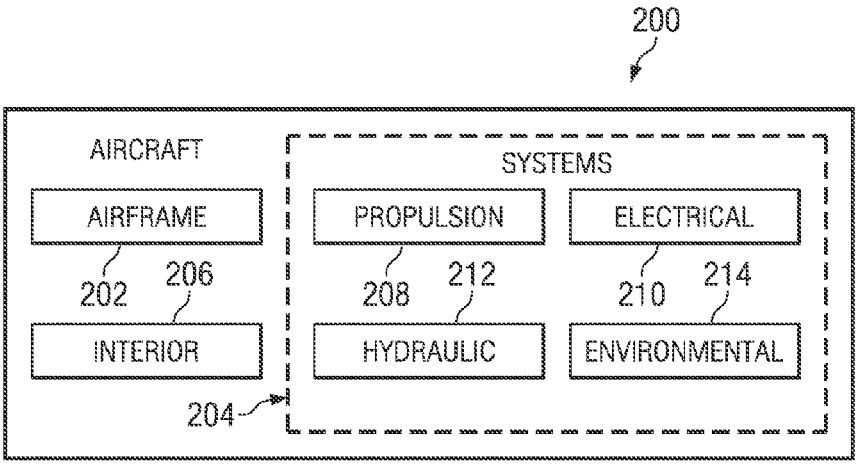
FIG. 2 is a diagram of an aircraft in accordance with an advantageous embodiment.

Referring more particularly to the drawings, embodiments of the disclosure may be described in the context of the aircraft manufacturing and service method 100 as shown in FIG. 1 and aircraft 200 as shown in FIG. 2. Turning first to FIG. 1, a diagram illustrating an aircraft manufacturing and service method is depicted in accordance with an advantageous embodiment. During pre-production, exemplary aircraft manufacturing and service method 100 may include specification and design 102 of aircraft 200 in FIG. 2 and material procurement 104.

During production, component and subassembly manufacturing 106 and system integration 108 of aircraft 200 in FIG. 2 take place. Thereafter, aircraft 200 in FIG. 2 may go through certification and delivery 110 in order to be placed in service 112. While in service by a customer, aircraft 200 in FIG. 2 is scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, or other suitable entity.

With reference now to FIG. 2, a diagram of an aircraft is depicted in which an advantageous embodiment may be implemented. In this example, aircraft 200 is produced by aircraft manufacturing and service method 100 in FIG. 1 and may include airframe 202, interior 206, and a plurality of systems 204. Examples of systems 204 include one or more of propulsion system 208, electrical system 210, hydraulic system 212, and environmental system 214. Any number of other systems may be included. Although an aerospace example is shown, different advantageous embodiments may be applied to other industries, such as, for example, the automotive industry.

Apparatus and methods embodied herein may be employed during any one or more of the stages of aircraft manufacturing and service method 100 in FIG. 1. For example, components or subassemblies produced in component and subassembly manufacturing 106 in FIG. 1 may be fabricated or manufactured in a manner similar to components or subassemblies produced while aircraft 200 is in service 112 in FIG. 1.

Also, one or more apparatus embodiments, method embodiments, or a combination thereof may be utilized during production stages, such as component and subassembly manufacturing 106 and system integration 108 in FIG. 1, for example, without limitation, by substantially expediting the assembly of or reducing the cost of aircraft 200. Similarly, one or more of apparatus embodiments, method embodiments, or a combination thereof may be utilized while aircraft 200 is in service 112 or during maintenance and service 114 in FIG. 1.

As a specific example, an edge seal applicator according to an advantageous embodiment may be used to seal components within aircraft 200. In particular, seals may be created on surfaces of various components such as, for example, stringers, skin panels, and other suitable components in airframe 202 and/or interior 206.

The different advantageous embodiments recognize that currently available systems for applying sealants may be time consuming and are not ergonomic for users. Current systems may require repetitive motions to evenly apply the sealant.

Thus, the different advantageous embodiments provide a method and apparatus for applying sealants to a surface. In the different advantageous embodiments, an apparatus has a housing with a cavity, a moveable applicator, and at least one channel. The moveable applicator is attached to the housing and may be, for example, a wheel. Each channel has an inlet in communication with the cavity and an outlet in communication with the moveable applicator. Further, the apparatus also may include a set of posts in which the posts may redistribute excess sealant back on to the surface of the moveable applicator.

Figure 3:
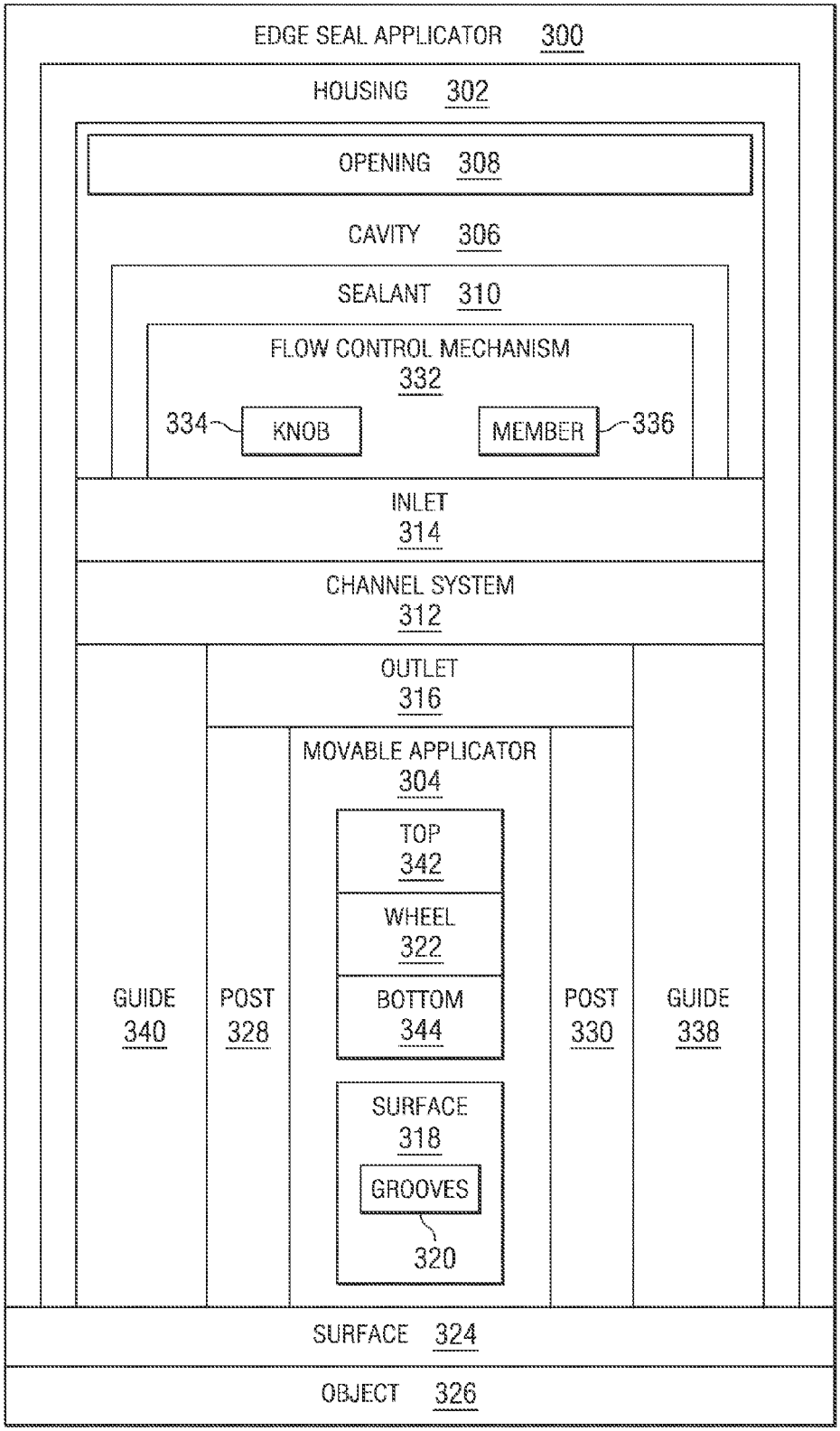
FIG. 3 is a block diagram of an edge seal applicator in accordance with an advantageous embodiment.

With reference now to FIG. 3, a block diagram of an edge seal applicator is depicted in accordance with an advantageous embodiment. In this example, edge seal applicator 300 includes housing 302. Moveable applicator 304 is moveably attached to housing 302. Housing 302 includes cavity 306 with opening 308.

In these examples, housing 302 may be made from various materials. For example, housing 302 may be formed from aluminum, steel, plastic, or any other suitable material. In these examples, the material may be any material capable of resisting a sealant and/or any cleaners or solvents that may be used to clean and/or remove sealant 310 from cavity 306 or other portions of housing 302. In these examples, the material may be any material capable of resisting solvents, such as, for example, methyl polyketone (MPK) solvents. Examples of materials include, for example, without limitation, nylon, polycarbonate, ultra-high molecular weight polyethylene (UHMWPE), high-density polyethylene (HDP), and other suitable materials.

Sealant 310 may be introduced and/or placed into cavity 306 through opening 308. In these examples, sealant 310 may be a viscous material that may change states and become solid once applied. Sealant 310 is used to prevent the penetration of various materials such as, for example, without limitation, air, gas, noise, liquid, or some other material. In these examples, sealant 310 may provide corrosion resistant and/or resistance to various environments. Sealant 310 may be, for example, without limitation, an acrylic sealant, a polysulfide sealant, a polyurethane sealant, a silicone sealant, an epoxy sealant, or some other suitable material.

In these examples, channel system 312 is present within housing 302. Channel system 312 has inlet 314, which is in communication with cavity 306. Channel system 312 also has outlet 316, which is in communication with moveable applicator 304. In these examples, channel system 312 may be a set of channels. A set as used herein refers to one or more items. For example, a set of channels is one or more channels. Inlet 314 may be one or more openings into channels within channel system 312 while outlet 316 may be one or more openings from channels within channel system 312.

Channel system 312 may be in communication with cavity 306 and moveable applicator 304 in a manner that allows sealant 310 to travel through channel system 312 onto surface 318 of moveable applicator 304. Outlet 316 does not need to be on or immediately adjacent to moveable applicator 304 in the illustrative examples. Outlet 316 may only need to be positioned or located such that outlet 316 may allow sealant 310 to flow and/or become deposited onto surface 318 of moveable applicator 304.

In this example, moveable applicator 304 is rotatable such that moveable applicator 304 may rotate 360 degrees. In other advantageous embodiments, moveable applicator 304 may have a more limited movement depending on the particular implementation. For example, in another embodiment, moveable applicator 304 may rotate 270 degrees.

Surface 318 of moveable applicator 304 is configured to retain at least a portion of sealant 310 on surface 318 while moveable applicator 304 moves. For example, surface 318 may include grooves 320 that may aid in retaining a portion of sealant 310 on surface 318. In these examples, grooves 320 may have various patterns. The pattern may be, for example, without limitation, a knurl pattern, a diamond pattern, a tread pattern that allows for overflow on the entire width of surface 318, parallel slots, or some other suitable pattern.

In these examples, moveable applicator 304 may take the form of wheel 322. Of course, in other advantageous embodiments moveable applicator 304 may have other shapes. For example, moveable applicator 304 may be a multi-surfaced polygon.

Moveable applicator 304 may move with sealant 310 on surface 318 in a manner that deposits and/or applies sealant 310 onto surface 324 of object 326. For example, a user may hold and move housing 302 of edge seal applicator 300 such that surface 318 of moveable applicator 304 touches surface 324 of object 326. Sealant 310, located on surface 318, may contact and adhere or stick to surface 324 of object 326.

In these illustrative examples, surface 324 may be an edge for object 326 which may be a composite part. For example, object 326 may be, for example, without limitation, a composite stringer, a wing panel, a rib, or some other suitable part.

Edge seal applicator 300 has post 328 and post 330. Post 328 and post 330 may be located opposite to each other with moveable applicator 304 located between post 328 and post 330. Further, post 328 and post 330 may be shaped and/or configured to redistribute excess sealant onto surface 318 of moveable applicator 304. In other words, post 328 and post 330 may scrape excess sealant 310 and smooth the flow of sealant 310 onto moveable applicator 304. Further, in some advantageous embodiments, channel system 312 may feed into post 328 and post 330 to supply sealant 310 onto surface 318 of moveable applicator 304.

In these depicted examples, edge seal applicator 300 also may include flow control mechanism 332. Flow control mechanism 332 may control and/or change the amount of communication of inlet 314 with cavity 306. Inlet 314 may be a set of holes or other openings within cavity 306 leading to channel system 312.

In other words, flow control mechanism 332 may be used to control the amount of sealant 310 that enters channel system 312 and becomes deposited on surface 318 of moveable applicator 304. In these examples, flow control mechanism 332 may comprise knob 334 and member 336. A user may rotate knob 334 to change the location of member 336 with respect to inlet 314 and/or an interior portion of channel system 312. In other words, movement of member 336 may open or close off access to inlet 314 and/or an interior portion of channel system 312. Of course, depending on the particular implementation, additional knobs and members may be present to control access to different channels within channel system 312 or to different openings within inlet 314.

By changing the position of member 336, the amount of sealant 310 that may enter channel system 312 may be controlled and/or changed. Flow control mechanism 332 may be adjusted to close off inlet 314 from cavity 306 to prevent sealant 310 from flowing when edge seal applicator 300 is not in use.

Additionally, edge seal applicator 300 may include guide 338 and guide 340. Guide 338 and guide 340 may protect surface 324 and may help guide movement of edge seal applicator 300 along surface 324 of object 326. In these illustrative examples, guide 338 and guide 340 may be removable and/or replaceable guides. These guides may have a smooth surface that may ride or slide along surface 324.

In these examples, flow control mechanism 332 also may be adjustable to allow adjustments for different viscosities of materials that may be placed into cavity 306.

When moveable applicator 304 takes the form of wheel 322, wheel 322 may allow application of sealant 310 along multiple sides. For example, sealant 310 may be applied from top 342 and bottom 344 of wheel 304. Of course, additional sides may be present depending on the particular implementation.

In these examples, edge seal applicator 300 may provide a gravity feed system in which sealant 310 flows from cavity 306 into channel system 312 and onto surface 318 of moveable applicator 304 through the pull of gravity.

Further, housing 302 may have a size and/or configuration providing for a capability of being held and/or manipulated by a human hand. Housing 302 may be configured such that edge seal applicator 300 may be used by either a left-handed or right-handed person.

Further, the different components such as, for example, without limitation, moveable applicator 304 and flow control mechanism 332, may be easily removable to allow for easy cleanup for multiple reuses. The different components may be designed to be removable without a need for tools. In these illustrative examples, the different components in edge seal applicator 300 may be selected such that those components may be capable of withstanding a solvent bath cleaning.

The illustration of edge seal applicator 300 in FIG. 3 is provided for purposes of illustrating different features that may be found in the advantageous embodiments. This illustration in FIG. 3 is not meant to imply physical and/or architectural limitations to the manner in which various advantageous embodiments may be implemented. For example, in some advantageous embodiments, a single post or a set of posts may be used.

In other words, a single post may be present instead of post 328 and post 330. In these examples, housing 302 may have various dimensions depending on the particular implementation. These dimensions may include one suitable for holding edge seal applicator 300 in a human hand. Further, housing 302 may have various shapes and sizes depending on the embodiment. In some examples, housing 302 may be square in shape, rectangular in shape, or some other suitable shape. In other advantageous embodiments, housing 302 may include curves, rounded edges, and/or other suitable features for holding and/or manipulating housing 302 by human hand. As another example, in some advantageous embodiments, only guide 340 may be present rather than having both guide 340 and guide 342. In some advantageous embodiments, guide 340 and guide 342 may be integral or part of post 328 and post 330, respectively.

Figure 4:
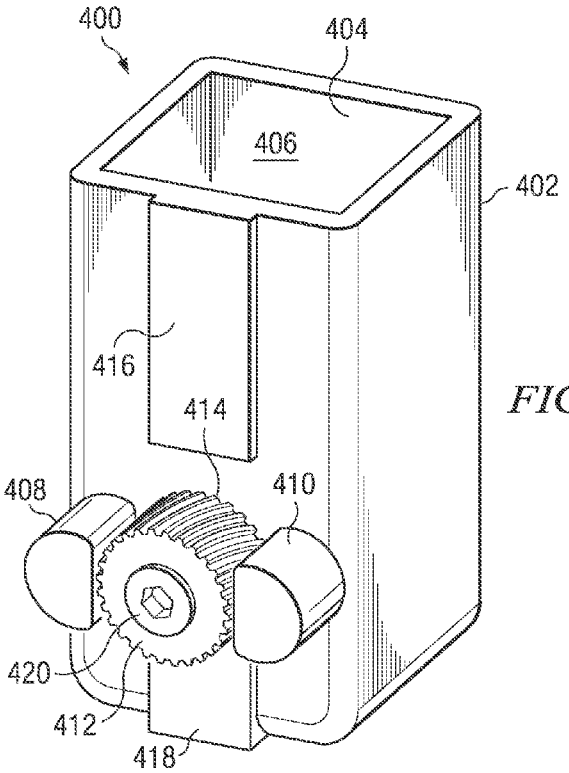
FIG. 4 is a perspective view of an edge seal applicator in accordance with an advantageous embodiment.

With reference now to FIG. 4, a perspective view of an edge seal applicator is depicted in accordance with an advantageous embodiment. Edge seal applicator 400 is an example of one implementation of edge seal applicator 300 in FIG. 3.

As illustrated, edge seal applicator 400 has housing 402. Housing 402 has opening 404, which leads to cavity 406. In this example, housing 402 includes post 408 and post 410. Post 408 and post 410 may be integrally formed as part of housing 402. In other advantageous embodiments, post 408 and post 410 may be attached to housing 402.

In this example, wheel 412 is moveably attached to housing 402. Wheel 412 is located between post 408 and post 410 in these examples. Wheel 412 has surface 414, which may have a pattern of grooves. Housing 402 also has guide 416 and guide 418. Guide 416 and guide 418 may aid in moving housing 402 on the surface of an object. Wheel 412 is rotatably attached to housing 402 using rod 420.

Figure 5:
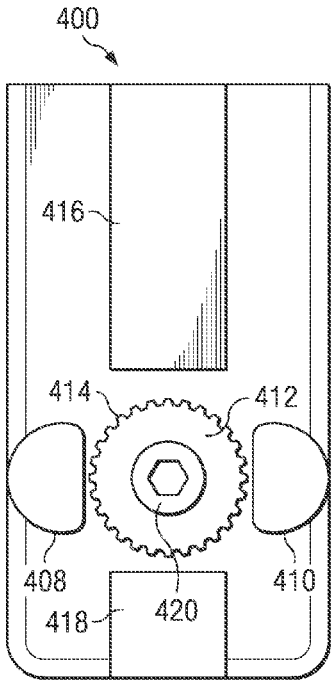
FIG. 5 is a front view of an edge seal applicator in accordance with an advantageous embodiment.
Figure 6:
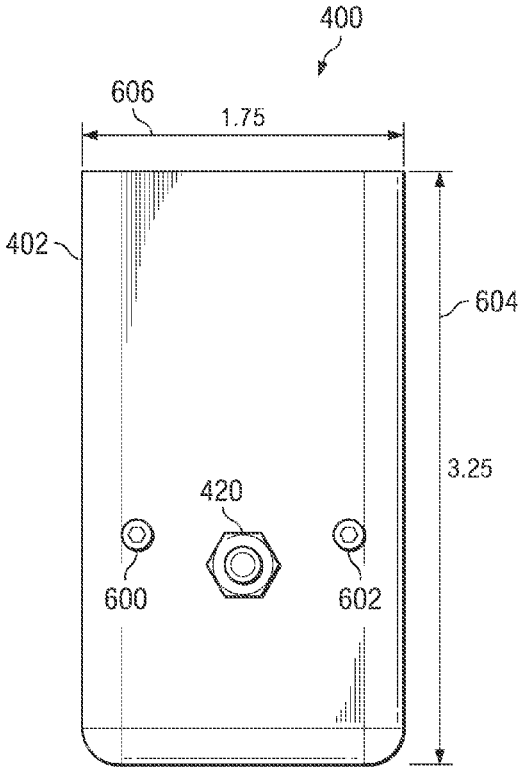
FIG. 6 is a diagram of a back view of an edge seal applicator in accordance with an advantageous embodiment.

With reference now to FIG. 5, a front view of an edge seal applicator is depicted in accordance with an advantageous embodiment. In FIG. 6, a back view of an edge seal applicator is depicted in accordance with an advantageous embodiment. In this example, knob 600 and knob 602 are present. Knob 600 and knob 602 may be manipulated to control the flow of a sealant onto surface 414 of wheel 412 in FIG. 4.

In this depicted example, housing 402 may have a shape in a configuration suitable for being held and/or manipulated by human hand. As illustrated, side 604 of housing 402 has a length of around 3.25 inches, while side 606 of housing 402 has a width of around 1.75 inches. Of course, other dimensions may be employed depending on the particular implementation.

Figure 7:
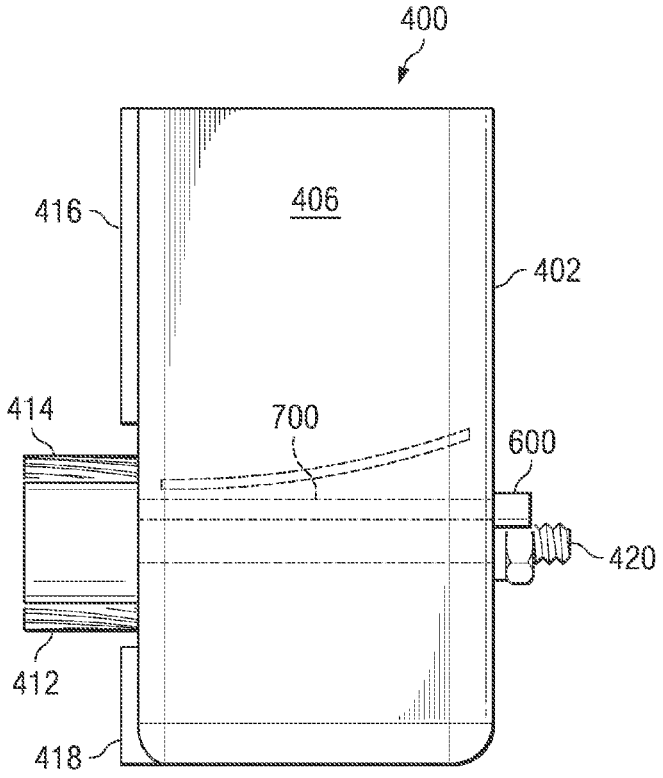
FIG. 7 is a side view of an edge seal applicator in accordance with an advantageous embodiment.

Turning next to FIG. 7, a side view of an edge seal applicator is depicted in accordance with an advantageous embodiment. In this example, rod 420 is shown extending through housing 402. Further, knob 600 is attached to rod 700 for manipulation by a human operator to control the flow of a sealant onto surface 414 of wheel 412.

Figure 8:
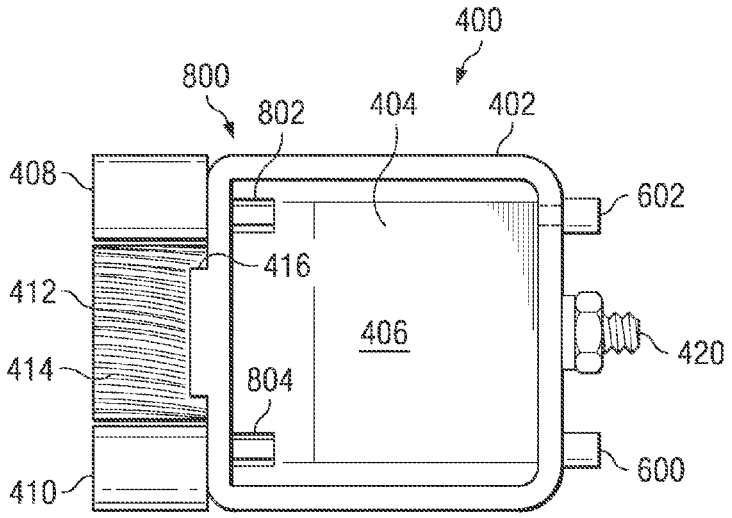
FIG. 8 is a top view of an edge seal applicator in accordance with an advantageous embodiment.

With reference now to FIG. 8, a diagram of a top view of an edge seal applicator is depicted in accordance with an advantageous embodiment. In this view, edge seal applicator 400 may include channel system 800, which is formed from channel 802 and channel 804. These channels provide communication between cavity 406 and surface 414 of wheel 412.

Knob 600 and knob 602 may be adjusted to open and close channel 802 and channel 804. Channel 802 and channel 804 also may be partially opened or closed, depending on the positioning of members such as, for example, rod 700. Another rod is attached to knob 602 which is not shown in this view. In these examples, channel 802 and channel 804 may lead into and through post 408 and post 410 to provide a flow of sealant onto surface 414 of wheel 412.

Figure 9:
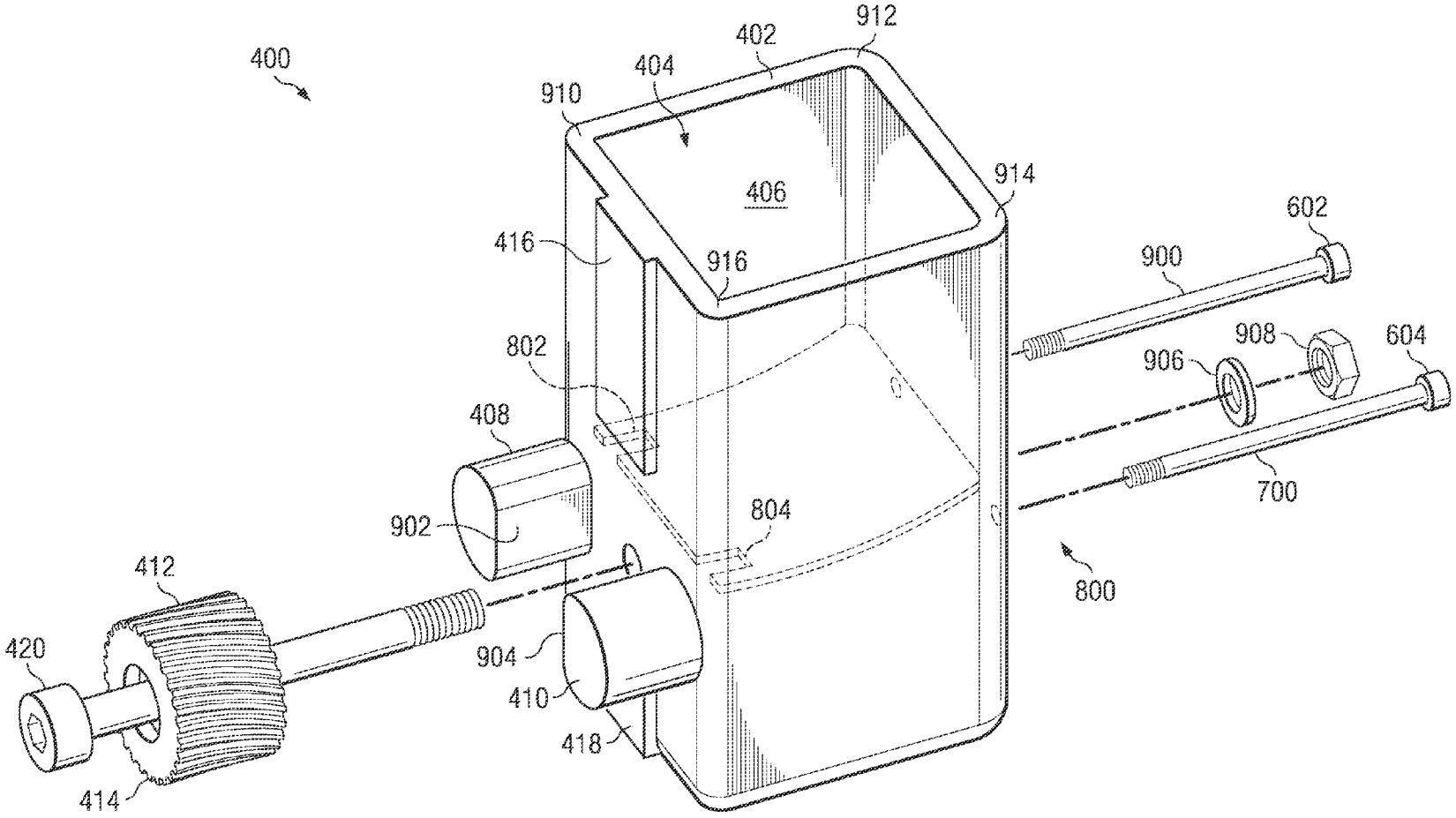
FIG. 9 is an exploded view of an edge seal applicator in accordance with an advantageous embodiment.

With reference now to FIG. 9, an exploded view of an edge seal applicator is depicted in accordance with an advantageous embodiment. In this example, rod 900 also may be seen in addition to rod 700. Rod 900, rod 700, knob 602, and knob 604 form a flow control mechanism.

As can be seen in this illustrative example, post 408 includes outlet 902 and post 410 includes outlet 904. These outlets may connect to channel 802 and channel 804, respectively. These outlets may provide communication with surface 414 of wheel 412 to allow sealant to flow from cavity 406 onto surface 414 of wheel 412. Further, post 408 and post 410 may function to redistribute excess sealant onto or around surface 414 while wheel 412 rotates.

As seen in this illustration, fastener 906 and fastener 908 may be used to retain rod 420 within housing 400. These fasteners may be removable without requiring the use of tools for easy assembly and disassembly for purposes of maintenance and cleaning.

Housing 402 has rounded edges 910, 912, 914, and 916 to provide better ergonomics for handling and manipulation of housing 402 by a human hand. Of course, the size, shape, and edges of housing 402 may vary depending on the particular implementation.

Further, the configuration of housing 402 with cavity 406 provides for a gravity feed system in which housing 402 may be tilted at a number of different angles, while still allowing sealant to move from cavity 406 onto surface 414 of wheel 412 through channels 802 and 804.

The illustration of edge seal applicator 400 in FIGS. 4-9 has been provided for purposes of illustrating one manner in which an edge seal applicator may be implemented. These illustrations are not meant to imply physical and/or architectural limitations to the manner in which other advantageous embodiments may be implemented.

Figure 10:
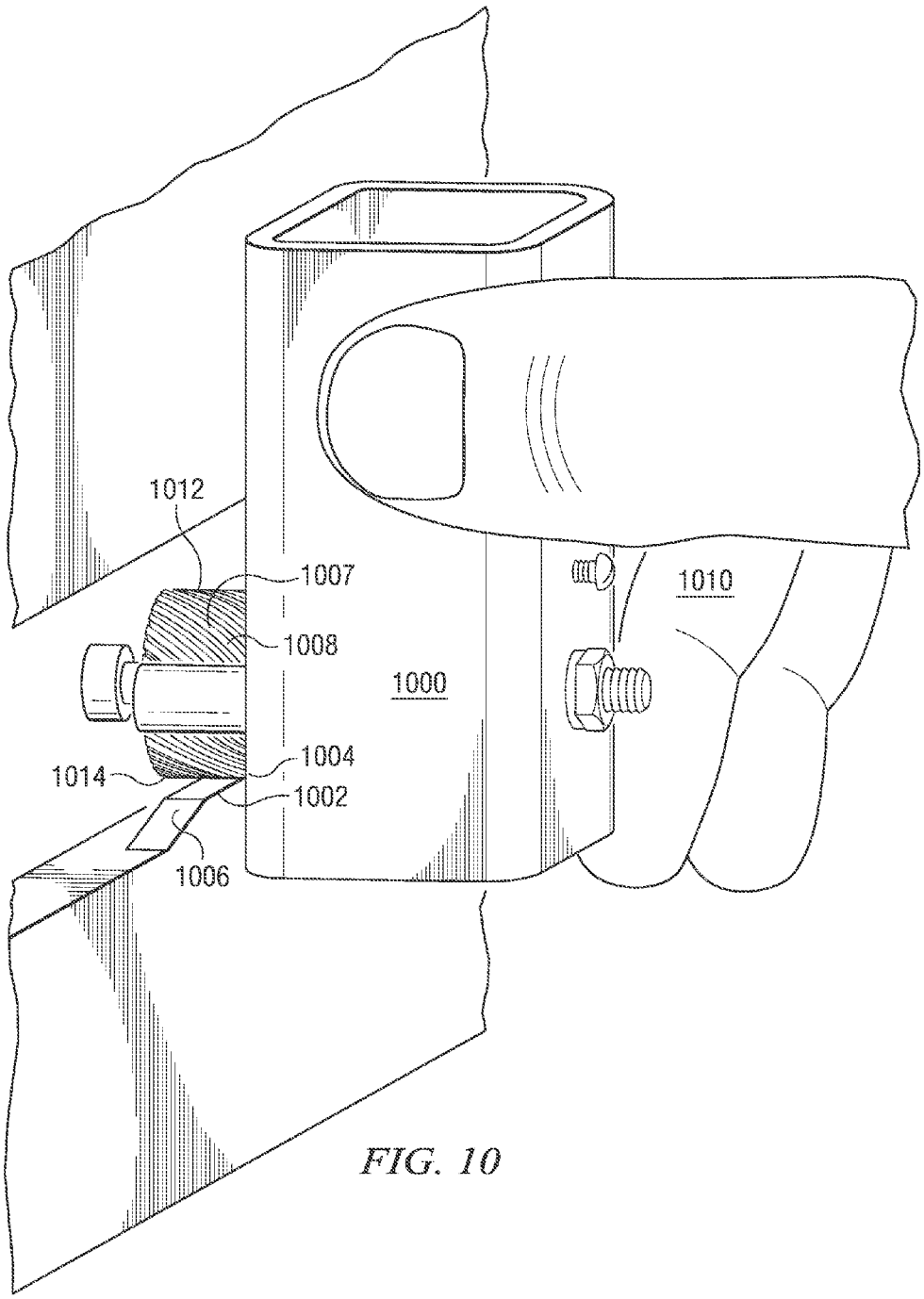
FIG. 10 is a diagram illustrating use of an edge seal applicator in accordance with an advantageous embodiment.

With reference now to FIG. 10, a diagram illustrating use of an edge seal applicator is depicted in accordance with an advantageous embodiment. In this example, edge seal applicator 1000 may be moved along edge 1002 in a manner to deposit sealant 1004 onto surface 1006 of edge 1002. In this example, a guide, such as guide 418 of FIG. 4, may guide movement of edge seal applicator 1000 along surface 1006 of edge 1002. As can be seen in this example, sealant 1004 may be applied to surface 1006 as surface 1007 of wheel 1008 rotates with sealant 1004 on surface 1007 of wheel 1008.

As can be seen in this example, edge seal applicator 1000 is suitable for being held and manipulated by human hand 1010. In this example, edge seal applicator 1000 may be rotated at different angles. In the depicted example, sealant 1004 is applied from bottom side 1014 of wheel 1008.

In other advantageous embodiments, sealant may be applied from top side 1012 of wheel 1008. In this manner, sealant 1004 may be applied to the underside of surfaces more easily using edge seal applicator 1000. The configuration of edge seal applicator 1000 using wheel 1008 also makes it easier for sealant 1004 to be applied to surfaces having other angles or orientations.

Figure 11:
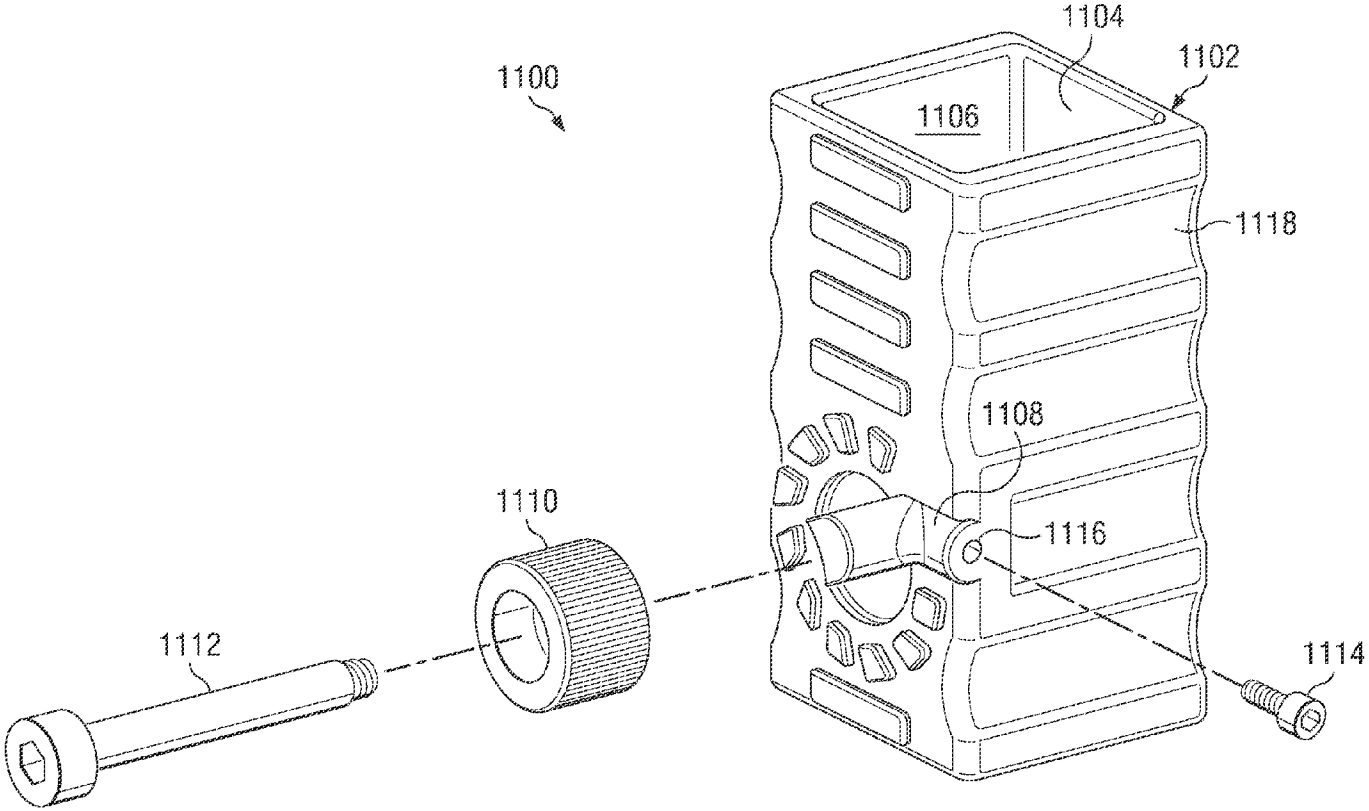
FIG. 11 is an exploded view of an edge seal applicator in accordance with an advantageous embodiment.

With reference now to FIG. 11, an exploded view of an edge seal applicator is depicted in accordance with an advantageous embodiment. In this example, edge seal applicator 1100 is an example of another implementation of edge seal applicator 300 in FIG. 3.

As depicted, edge seal applicator 1100 has housing 1102, which has opening 1104, leading to cavity 1106 within housing 1102. In this illustrative example, housing 1102 has single post 1108, rather than two posts as shown in the other illustrative embodiments. Wheel 1110 is moveably secured to housing 1102 by rod 1112. Knob 1114 may be moveable to different positions within channel 1116 to regulate the amount of sealant that may flow from cavity 1106 through single post 1108 onto wheel 1110.

Further, housing 1102 has shaped surface 1118. Shaped surface 1118 is configured to allow for easier handling by a human operator. Further, the dimensions of housing 1102 also may be selected to increase the ergonomics for human use.

Figure 12:
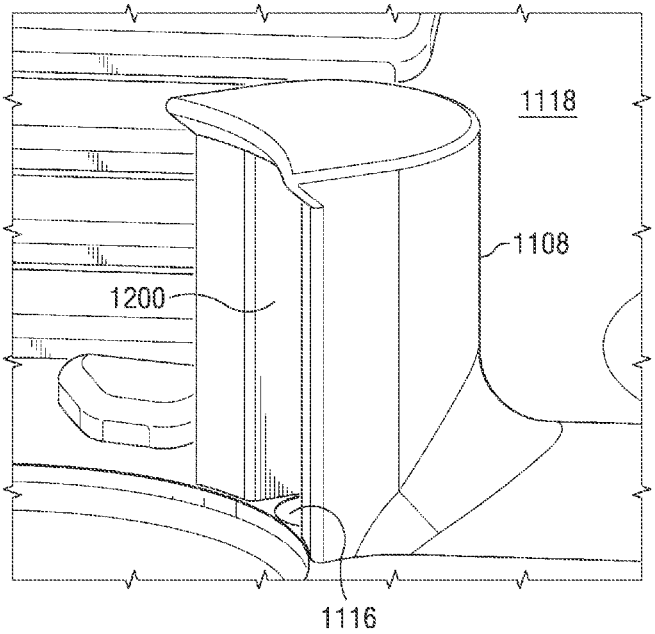
FIG. 12 is a view of a single post for an edge seal applicator in accordance with an advantageous embodiment.

With reference now to FIG. 12, a view of a single post for an edge seal applicator is depicted in accordance with an advantageous embodiment. In this example, a more detailed view of single post 1108 is presented. As can be seen, single post 1108 has channel 1200, which leads to cavity 1106. Knob 1114 may be positioned such that a portion of channel 1200 leading to cavity 1106 may be blocked.

The amount of blockage caused by the position of knob 1114 in channel 1116 may be selected to control the flow of sealant from cavity 1106 into channel 1200. As can be seen, in this example, channel 1200 has a configuration that causes sealant to be spread onto the surface of wheel 1110.

Figure 13:
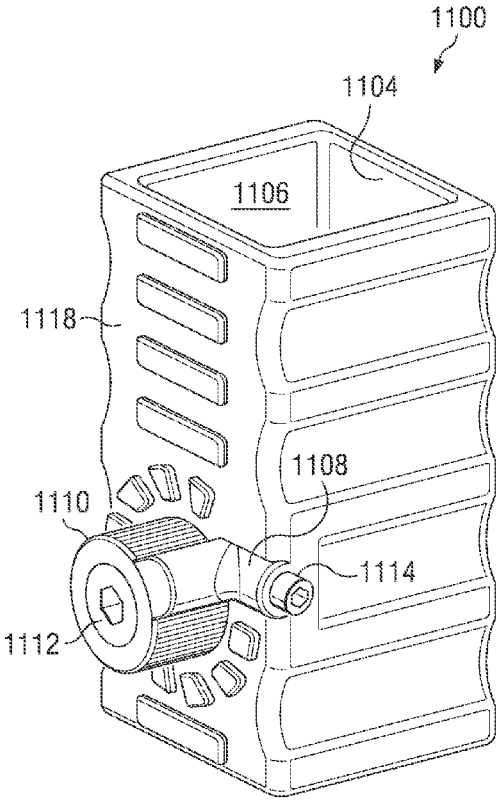
FIG. 13 is a diagram illustrating a perspective view of an edge seal applicator in accordance with an advantageous embodiment.

With reference now to FIG. 13, a diagram illustrating a perspective view of an edge seal applicator is depicted in accordance with an advantageous embodiment. In this example, edge seal applicator 1100 is shown in a fully assembled view.

The illustration of edge seal applicator 1100 in FIGS. 11-13 have been provided as another example of an implementation of edge seal applicator 300 in FIG. 3. This illustration is not meant to imply physical or architectural limitations to a manner in which other advantageous embodiments may be implemented.

Figure 14:
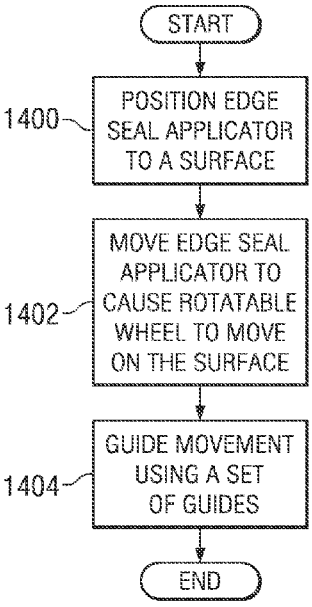
FIG. 14 is a flowchart of a process for applying a sealant to a surface of an object in accordance with an advantageous embodiment.

With reference now to FIG. 14, a flowchart of a process for applying a sealant to a surface of an object is depicted in accordance with an advantageous embodiment. The process illustrated in FIG. 14 may be implemented using edge seal applicator 400 in FIG. 4.

The process begins by positioning the edge seal applicator relative to a surface (operation 1400). Thereafter, the process moves the edge seal applicator to cause the wheel to rotate and move on the surface (operation 1402). Movement of the edge seal applicator may be guided using a set of guides (operation 1404) with the process terminating thereafter.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a housing having a cavity;

a moveable applicator moveably attached to the housing;

at least one channel having an inlet in communication with the cavity and an outlet in communication with the moveable applicator; and a flow control mechanism for changing an amount of communication between the cavity and the inlet for the at least one channel.

2. The apparatus of claim 1 further comprising:

a number of posts on the housing located adjacent to the moveable applicator.

3. The apparatus of claim 2, wherein the number of posts comprises a first post and a second post, wherein the first post is located opposite to the second post and wherein the moveable applicator is located between the first post and the second post.

4. The apparatus of claim 1, wherein the moveable applicator is a wheel.

5. The apparatus of claim 4, wherein the wheel has a surface configured to retain at least a portion of a sealant on the surface while the wheel moves.

6. The apparatus of claim 5, wherein the surface has a set of grooves having a pattern.

7. The apparatus of claim 6, wherein the pattern is selected from one of a knurl pattern, a treaded pattern, parallel slots, or a diamond pattern.

8. The apparatus of claim 2, wherein the at least one channel extends through at least one post in the number of posts.

9. The apparatus of claim 2, wherein the number of posts is configured to redistribute excess sealant onto the moveable applicator.

10. The apparatus of claim 2 further comprising:

a number of guides on the housing.

11. The apparatus of claim 10, wherein the number of guides is replaceable.

12. The apparatus of claim 1, wherein the housing has a configuration and size capable of being held by a human hand.

13. The apparatus of claim 1, wherein the cavity and the at least one channel form a gravity feed system for a sealant placed in the cavity.

14. An apparatus for applying a sealant, the apparatus comprising:

a housing having a cavity;

a wheel moveably attached to the housing;

a number of posts located adjacent to the wheel, the number of posts configured to redistribute excess sealant onto the wheel; and at least one channel having an inlet in communication with the cavity and an outlet in communication with the wheel.

15. The apparatus of claim 10, wherein the number of guides is configured to guide movement of the housing in relation to a surface.

* * * * *